United States Patent [19]

Hixon

[11] Patent Number: 4,874,047

[45] Date of Patent: Oct. 17, 1989

[54] METHOD AND APPARATUS FOR RETAINING ROLLER CONE OF DRILL BIT

[75] Inventor: Charles E. Hixon, Houston, Tex.

[73] Assignee: Cummins Engine Company, Inc., Columbus, Ind.

[21] Appl. No.: 222,139

[22] Filed: Jul. 21, 1988

[51] Int. Cl.[4] ..... E21B 10/20; E21B 10/22; B21K 5/02

[52] U.S. Cl. ..... 175/369; 175/371; 384/95; 384/96; 76/108 A

[58] Field of Search ..... 175/367–372; 384/92–96; 29/435, 525; 76/108 A, 108 R

[56] References Cited

U.S. PATENT DOCUMENTS

| | | | |
|---|---|---|---|
| 4,145,094 | 3/1979 | Vezirian | 384/96 |
| 4,157,122 | 6/1979 | Morris | 175/371 X |
| 4,266,622 | 5/1981 | Vezirian | 384/92 X |
| 4,350,060 | 9/1982 | Vezirian | 76/108 A |
| 4,511,008 | 4/1985 | Brunson | 384/96 X |
| 4,572,306 | 2/1986 | Dorosz | 175/371 |
| 4,738,323 | 4/1988 | Mathews | 175/371 |

*Primary Examiner*—Bruce M. Kisliuk

*Attorney, Agent, or Firm*—Browning, Bushman, Zamecki & Anderson

[57] ABSTRACT

An improved apparatus and method for rotatably mounting and retaining a rock bit roller cone on a journal of a drill bit is disclosed. The bit body has at least one depending leg with an outer free end and an inner end continuous with the remainder of the bit body, and the cone surrounds the leg adjacent the outer end, forming an annular space between the leg and the cone. At least two retention bearing sleeves are disposed in the space: a first fixed to the leg and rotatable relative to the cone; and a second, disposed longitudinally inwardly of the first, fixed to the cone and rotatable relative to the leg. The retention bearing sleeves cooperate to prevent relative movement of the second sleeve longitudinally past the first.

20 Claims, 3 Drawing Sheets

FIG. 2
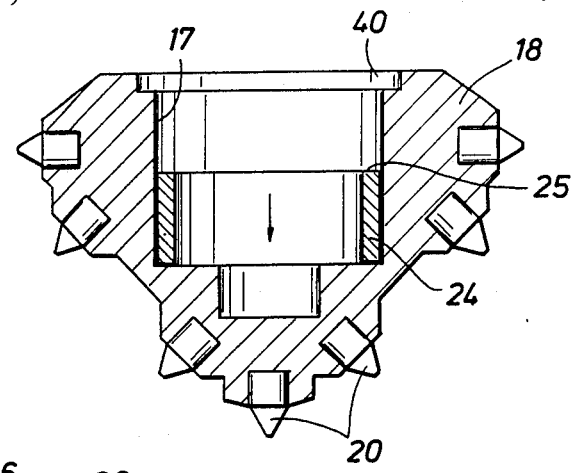
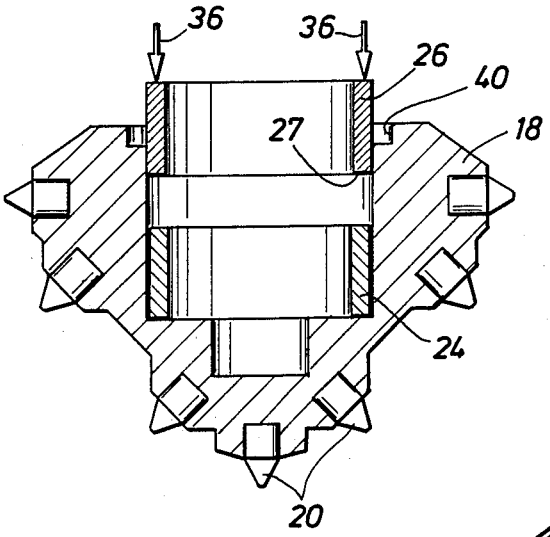
FIG. 3
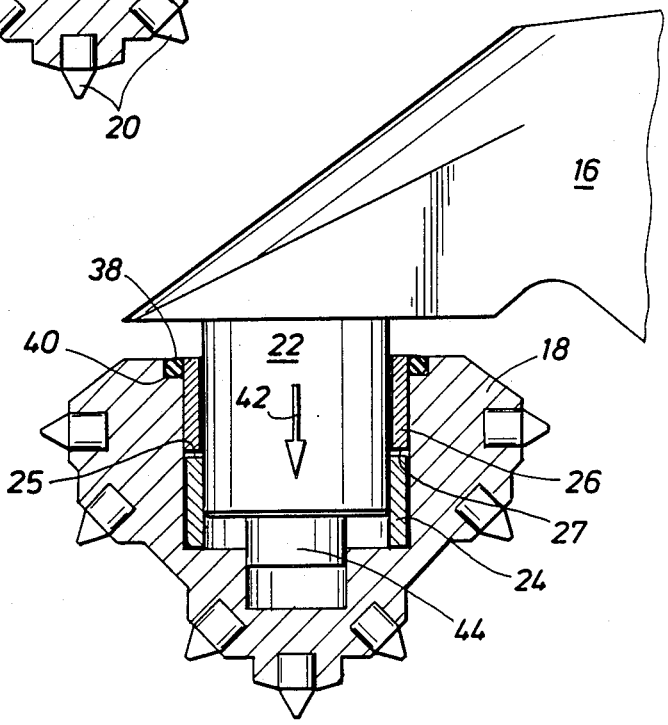
FIG. 4

METHOD AND APPARATUS FOR RETAINING ROLLER CONE OF DRILL BIT

BACKGROUND OF THE INVENTION

1. Field of the Invention

This invention relates generally to the manufacture of drill bits of the roller cone type such as are used in the oil and gas producing industry and, in particular, to an improved apparatus and method for rotatably mounting and retaining rock bit roller cones on a drill bit body.

2. Description of the Background

In a typical drill bit of the type having roller cones, there are three major components. These three components include the body of the drill bit, the roller cones, and the bearings which rotatably support the roller cones on the body of the drill bit. The bit body typically includes an uppermost pin for connection to the drill string, a mid portion below the pin which houses the nozzles and pressure compensators, and a plurality (typically three) of legs which depend generally downwardly from the mid portion. A respective roller cone is rotatably mounted on the end of each of these legs.

Although various bearing structures may be employed to rotatably support the roller cones on their respective legs of the body of the drill bit, journal-type bearings are one of the most widely used, the lower or outer portion of each leg of the body of the drill bit being formed into a journal. The roller cone may be rotatably locked onto the journal of its corresponding bit leg by means of a ball bearing system, a locking ring, or other locking device.

SUMMARY OF THE INVENTION

The present invention relates to an improved drill bit and a method for rotatably mounting and locking a roller cone onto its corresponding journal in a drill bit. The improvement in the drill bit comprises an improved roller cone retention mechanism and roller cone bearing design.

In a bit according to the present invention, an internal axial hollow of each cone is disposed in generally coaxially surrounding relation to the respective leg, adjacent the outer or free end thereof, and sized to define an annular space therebetween. A plurality of retention members are disposed in said annular space. A first of the retention members is affixed to the leg and rotatable relative to the cone. A second of the retention members—disposed longitudinally inwardly of the first retention member—is affixed to the cone and rotatable relative to the leg. The retention members have means cooperative therebetween to prevent relative movement of the first retention member longitudinally past the second retention member.

In preferred embodiments of the invention, the aforementioned means cooperative between the retention members to prevent relative longitudinal movement thereof may comprise respective generally axially facing retention surfaces of the retention members themselves, typically their end surfaces. Each of the retention members has such a retention surface opposed to a respective such retention surface of each adjacent retention member. In other words, the retention members are stacked endwise along the length of the annular space between the cone and the leg. The retention surfaces in each such opposed pair are in close enough proximity for sliding engagement.

At least the first and second retention members are preferably journal bearing sleeves or other radial bearing members. They may be affixed to the leg and cone, respectively, by interference fitting.

Even more preferably, the retention surfaces define substantially rectilinear profiles in longitudinal cross-section. Thus, the very same means which provide the radial bearing surfaces also serve to lock the cone onto the leg so that substantially uninterruped bearing surface area can be provided along a major pat of the length of the annular space, and indeed, along virtually the entire length, if desired. Furthermore, the aforementioned end surfaces or retention surfaces can bear inthrust loads on the cone, i.e. loads acting radially inwardly with respect to the longitudinal axis of the bit as a whole.

In a preferred method of making a bit according to the present invention the bit body leg and the cone may be considered the two major members of the assembly to be formed. It can be seen that the leg member will have outer wall means with a first end which is free and a second end which is continuous with the remainder of the bit body, while the cone member will have an axial internal hollow with inner wall means which likewise include a first end, adjacent the base of the cone and at which the hollow opens through the cone, and a second end adjacent the apex of the cone and which is closed. The method involves placing first retention means adjacent the second end of the respective wall means of one of the two main members of the assembly, and in relatively rotatable relation thereto, with the first retention means extending radially beyond the respective wall means to form a first axially facing shoulder. Then, a second retention means is affixed to said one member adjacent the first end of its respective wall means with the second retention means also extending radially beyond the respective wall means to form a second axially facing shoulder, facing in a direction opposed to the first shoulder. The two shoulders may thus prevent relative longitudinal movement of the two retention means, either directly or through additional intermediary retention means or members.

Next, the two main members of the assembly, i.e. the leg and the cone, are telescoped so as to place the inner wall means of the cone in coaxial surrounding relation to the outer wall means of the leg as well as in relatively rotatable relation to the aforementioned second retention means, and the other of said members is affixed to the first retention means. The "telescoping" may or may not involve sliding contact, depending on the method by which the parts are affixed, e.g. interference fitted or welded.

Thus, for example, considering the cone as the one member of the assembly, a first retention means in the form of a journal sleeve, sized for a running fit within the inner wall means of the cone, may be placed in the hollow of the cone, adjacent the second end thereof, i.e. the closed end. Next, a second journal sleeve, of slightly greater outer diameter than the first, may be press fitted into the hollow of the cone adjacent the first or open end thereof. The two sleeves may be sized so that their adjacent ends oppose each other in close proximity for sliding engagement. Finally, the journal portion of the leg may be press fitted or otherwise interference fitted into the first journal bearing sleeve, thereby simultaneously telescoping the main members of the assembly while affixing the journal to said first sleeve.

With the journal thus fixed to the first sleeve, which in turn is located near the apex of the cone, the cone itself fixed to the second sleeve, which is located near the base of the cone, and the ends of the two sleeves opposed to each other, the cone will be locked onto the leg, i.e. will be prevented from falling or slipping off the leg. Meanwhile, depending on their sizes, the aforementioned sleeves can provide radial bearing surface area along a substantial portion of the length of the telescoped portions of the two members, i.e. the annular space formed therebetween. If the opposed ends of the sleeves are in close proximity for sliding engagement, they can also bear in-thrust loads on the cone.

The use of such retention means eliminates the need for the ball bearings that are commonly used to lock roller cones on journals. The sleeve-type locking mechanism is easier to manufacture than the ball bearing type locking mechanism because there is no longer any need to create a ball race surface in the journal or to create a ball race surface in the roller cone. The present invention therefore provides great savings in manufacturing time and effort.

In addition, the sleeve structure of the invention increases the bearing surface area far beyond that obtainable with the traditional ball bearing design, because the bearing surface area of a sphere such as a bearing ball is limited to the relatively small point of contact that the sphere makes with its complementarily shaped ball race surface.

It is an object of the invention to provide an improved apparatus and method for rotatably mounting and retaining roller cones on a journal of a drill bit.

Another object of the invention is to maximize the available bearing surface area between a roller cone and a journal of a drill bit on which the roller cone is mounted.

Another object of the invention is to provide means for rotatably locking a roller cone on a journal of a drill bit without the need for cutting a ball race surface in the journal or in the roller cone.

Still another object of the invention is to increase the strength of the drill bit by obviating the need to drill a ball bearing access hole through the body of the drill bit.

Yet another object of the invention is to provide a simple method for assembling the apparatus of the invention.

Other objects and advantages of the invention will become apparent from the consideration of the detailed description and the drawings.

BRIEF DESCRIPTION OF THE DRAWINGS

FIG. 2 is a longitudinal cross-sectional view showing a first step in forming one of the cone assemblies of the embodiment of FIG. 1.

FIG. 3 a view similar to that of FIG. 2 showing a second the method.

FIG. 4 a view similar to those of FIGS. 2 and 3 showing a third step in the method.

DETAILED DESCRIPTION OF THE PREFERRED EMBODIMENT

Figure 1:
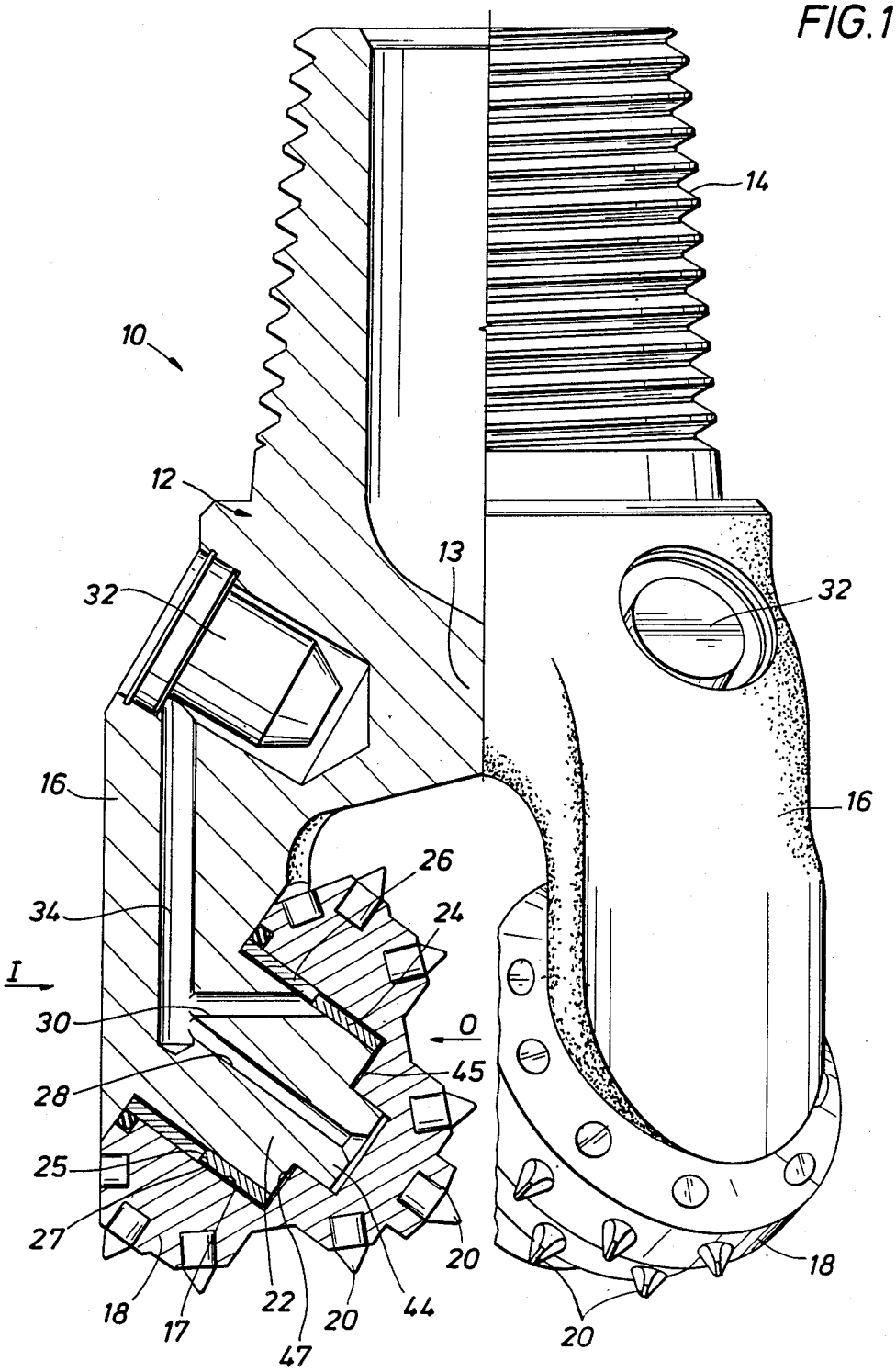
FIG. 1 is a quarter sectional view, taken through the longitudinal axis of one of the cone assemblies, and with other parts broken away for clarity.

The improved drill bit of the present invention is depicted in FIG. 1. The drill bit is generally denoted by the numeral 10. A typical drill bit 10 comprises a drill bit body 12 having a threaded pin 14 adapted to be threaded into a drill string (not shown), a mid-portion 13 housing pressure compensator 32 and mud nozzles (not shown), and three legs 16 depending generally downwardly from mid-portion 13. A roller cone 18 is rotatably mounted on each leg 16. FIG. 1 depicts two of the three legs 16 and two of the three roller cones 18 of a typical drill bit 10. The left-hand side of drill bit 10 in FIG. 1 is shown in cross section. The right-hand side of drill bit 10 in FIG. 1 is shown in a perspective side view (except that a portion of the roller cone 18 mounted on the right-hand side of drill bit 10 is not shown so that one may clearly see the cross-sectional view of the roller cone 18 mounted on the left-hand side of drill bit 10). Each roller cone 18 is fitted with numerous teeth 20 which break up the rock formation when the drill bit 10 is rotated (and each roller cone 18 rotates on its respective leg 16) during the drilling process.

As shown in the cross-sectional view of the leg 16 in FIG. 1, the lowermost portion of leg 16 is formed into a cylindrical journal 22 at the outer or free end of which is a nose piece 44, also cylindrical but of smaller diameter. Journal 22 is adapted to fit within an axial interior hollow 17 of a roller cone 18. The interior hollow space 17 of the roller cone 18 is formed having dimensions larger than but paralleling the dimensions of the corresponding journal 22 onto which the roller cone 18 is to fit so as to form an annular space therebetween. As will be described more fully below, first sleeve 24 and second sleeve 26 of the invention are located in the annular space between the outer wall of journal 22 and the inner wall of the interior hollow space 17 of the roller cone 18 when roller cone 18 is mounted on the journal 22. As with similar types of journals known in the prior art, journal 22 is provided with lubrication passages 28 and 30, through which a lubricant from pressure compensating lubricant reservoir 32 may flow via lubricant passage 34 to lubricate the relatively rotating surfaces.

As used herein, the term "cone assembly" will refer to a cone such as 18, the journal portion 22 of a leg 16 on which that cone is mounted, and the bearing/retention means disposed therebetween. In the embodiment of FIG. 1, sleeves 24 and 26 serve the combined function of rotary bearing members and retention members for retaining the cone 18 on the journal 22. As mentioned, nose piece 44 generally represents the outer or free end of journal 22, as well as of leg 16 as a whole, and unless otherwise noted, terms such as "longitudinally inwardly" or "longitudinally outwardly" will be used with reference to the legs 16. Also, as used herein, terms such as "longitudinal" and "radial" will refer to the rotary axis of a given cone assembly, unless otherwise indicated.

Referring now to FIGS. 2 through 4, there are shown successive steps in a method of assembling a cone assembly according to the embodiment of FIG. 1.

The cone assembly itself can be further described in the context of its method of assembly. The method comprises a first step of placing first sleeve 24 into the hollow 17 within roller cone 18 as shown in FIG. 2. The first sleeve 24 fits within the interior hollow space 17 of the roller cone 18 with a free sliding or running fit. The outer diameter of the first sleeve 24 and the diameter of the interior hollow space within roller cone 18 are chosen so that first sleeve 24 will rotate freely around its axis when first sleeve 24 is seated within roller cone 18 as shown in FIG. 2. The innermost end surface 25 forms an axially facing retention shoulder extending radially inwardly from the inner wall of the hollow 17.

The next step in the method involves placing a second sleeve 26 within the interior hollow space 17 of roller cone 18 longitudinally inwardly of sleeve 24 as shown in FIG. 3. The outer diameter of second sleeve 26 is chosen so that second sleeve 26 may be interference fitted within the upper portion of the hollow 17 of roller cone 18. The arrows 36 shown in FIG. 3 indicate that second sleeve 26 is press fitted into position within the roller cone 18. Alternatively, second sleeve 26 may be shrink fitted into position within roller cone 18. Second sleeve 26 may also be affixed to cone 18 by other methods such as welding.

The length of first sleeve 24 and the length of second sleeve 26 are chosen so that when first sleeve 24 and second sleeve 26 are both fitted within the hollow interior space of roller cone 18, the top of second sleeve 26 will be located approximately at the level of the top surface of roller cone 18 as shown in FIG. 4. That is, the combined length of first sleeve 24 and second sleeve 26 extends along substantially the entire length of the journal 22. (The length of the nose piece 44 is not considered to be part of the length of journal 22.)

The inner diameter of second sleeve 26 is chosen so that the journal 22 may freely pass through the interior of second sleeve 26 with a sliding or running fit. The tolerance between the inner diameter of second sleeve 26 and the outer diameter of journal 22 allows the second sleeve 26 (and the roller cone 18 connected to said second sleeve 26) to rotate freely around journal 22. After second sleeve 26 is affixed within roller cone 18, an O-ring 38 is fitted within an O-ring groove 40 as shown in FIG. 4. O-ring 38 helps prevent the escape of lubricant from the spaces between roller cone 18 and journal 22.

After second sleeve 26 has been secured within the interior hollow space 17 of roller cone 18 as previously described, then journal 22 of drill bit 10 is passed through second sleeve 26. This step is depicted in FIG. 4. The inner diameter of first sleeve 24 is chosen so that journal 22 may be interference fitted into first sleeve 24. The arrow 42 in FIG. 4 indicates that journal 22 is press fitted against the interior lateral surface of first sleeve 24 in the exemplary embodiment.

After the apparatus of the invention has been assembled in the manner described above, both first sleeve 24 and second sleeve 26 serve as bearings between the journal 22 and the roller cone 18. The inner and outer diameters of the sleeves 24 and 26 are chosen so that the uppermost end 25 of the first sleeve 24 overlaps a portion of the lowermost end 27 of second sleeve 26 when first sleeve 24 and second sleeve 26 are in position around journal 22. That is, first sleeve 24 and second sleeve 26 are "stacked" relative to each other in a direction parallel to the axis of journal 22. In this configuration, opposed ends 25 and 27 block the axial movement of second sleeve 26 past first sleeve 24. Thus ends 25 and 27 serve as retention surfaces preventing roller cone 18, fixed to sleeve 26, from slipping off journal 22, fixed to sleeve 24. The freedom of rotation of the second sleeve 26 with respect to first sleeve 24 and the axial constraint imposed on second sleeve 26 by first sleeve 24 ensures that the roller cone 18 remains rotatably locked onto journal 22.

One advantage of the improved drill bit 10 of the invention over the prior art methods and apparatus is that the bearing surface area between the journal 22 and the roller cone 18 is maximized. In the example shown, the combined length of first sleeve 24 and second sleeve 26 extends along substantially the entire length of journal 22. Thus, the bearing surface area provided by the present invention is significantly greater than that achievable by the traditional roller cones that are locked in place by ball bearings. The bearing surface of a sphere such as a ball is limited to the relatively small point of contact that the sphere makes with its complementarily shaped ball race surface. This limitation is not present in the improved drill bit 10 of the invention. Even if, for example, sleeve 26 were shortened and O-ring 38 placed against the inner end of sleeve 26 in direct contact with journal 22, the total bearing area provided would be substantially greater than that in a typical ball bearing type cone assembly. Futhermore, given sufficiently close proximity of the opposed sleeve ends 25 and 27, this bearing area would be substantially continuous.

In addition, the manufacture of the improved drill bit 10 of the present invention is simplified because it is no longer necessary to do extra machine work to create ball race surfaces in the journal and roller cone. Because a ball bearing is not used in the improved drill bit 10 of the invention, it is also no longer necessary to drill an access hole through the leg 16 of drill bit body 12 to permit the balls to reach the ball race surface. The absence of the access hole not only further simplifies the manufacturing process, but also makes the leg 16 of the drill bit 10 stronger than it would be with an access hole drilled through it.

An additional advantage of the present invention pertains to the phenomena of in-thrust and out-thrust. During drilling, thrust loads are imposed on the cones of the bit in generally radial directions with respect to the center line of the bit as a whole. As their names imply, "in-thrust" denotes a force acting radially inwardly, while "out-thrust" denotes a force acting radially outwardly. Referring to FIG. 1, it can be seen that out-thrust denoted by the arrow 0, and exerted on the cone 18 will be borne by virtue of the engagability of shoulder 45, formed between the main large diameter portion of the journal 22 and its pilot piece 44, with a corresponding shoulder 47 in the mating cavity in cone 18. However, in prior bits, there was often little or no means for accommodating in-thrust, denoted by the arrow I.

It has already been mentioned that the journal 22 depends or extends generally downwardly from the bit body. However, it can be seen that, rather than extending straight downwardly like the upper part of the leg 16, the center line or axis of journal 22 is angled downwardly and inwardly toward the center line of the bit as a whole. For this reason, the juncture or end surfaces 25 and 27 do not lie precisely parallel to the in-thrust force I; and accordingly, these engagable end surfaces 25 and 27 on sleeves 24 and 26, fixed to the cone and journal respectively, can bear the in-thrust load I. In other words, these surfaces 25 and 27 form a thrust bearing.

Not all of the in-thrust load that acts on drill bit leg 16 is incident on the in-thrust bearing surfaces 25 and 27. Some portion of the in-thrust load will generally be incident on the lateral surface area between the roller cone and the journal 22. The only case in which there would be zero in-thrust load incident on the lateral surface area between the roller cone 18 and the journal 22 would be a case in which journal 22 were attached to the drill bit leg at a right angle. In such a case, all of the in-thrust load would be incident on the in-thrust bearing surfaces 25 and 27.

In any event, it is important to note that a substantial portion of the in-thrust will always be taken by the bearing surfaces 25 and 27. In the past, where in-thrust bearing surfaces other than the lateral surfaces of the journal sleeves themselves have been provided, e.g. where ball bearings have been used not only to retain the cone on the bit leg but also to provide some in-thrust bearing, this has necessitated the sacrifice of a significant portion of the length of the annular space between the cone and leg so that that sacrificed portion is not available for taking radial loads. Again considering the example of a ball bearing retention system, the length sacrificed is approximately the diameter of one of the bearing balls, because the radial bearing provided by that ball is, in essence, only point contact.

By way of contrast, with the arrangement of the present invention, surfaces 25 and 27 can take a substantial part of the in-thrust load, yet there is no sacrifice of potential radial bearing surface area which can, as in the embodiment shown, actually extend substantially the full length of journal 22.

Figure 5:
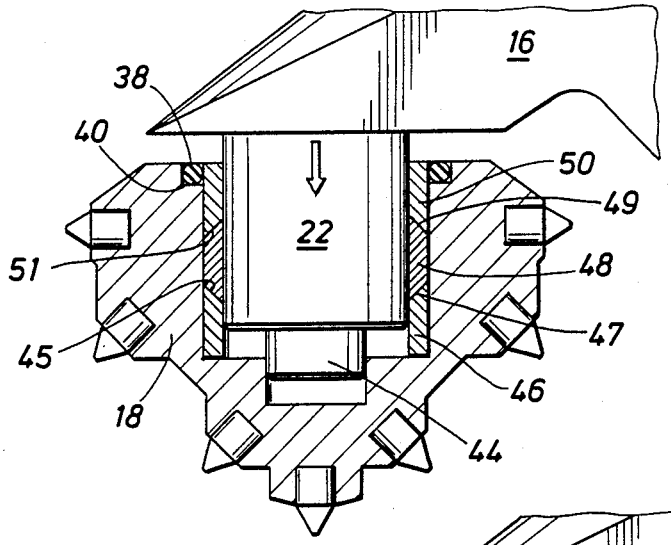
FIG. 5 is a longitudinal cross-sectional view of a cone assembly according to a second embodiment of the invention in a final of assembly.

Turning now to FIG. 5, there is shown a second embodiment of the invention which utilizes three journal sleeves, rather than two. First sleeve 46 in the embodiment shown in FIG. 5 has the same function as the first sleeve 24 in the embodiment shown in FIGS. 1–4, and FIG. 5 shows the final assembly step as journal 22 is press-fitted into sleeve 46. Similarly, second sleeve 50 in the embodiment shown in FIG. 5 has the same function as the second sleeve 26 in the embodiment shown in FIGS. 1–4. Third sleeve 48 in the embodiment shown in FIG. 5 is located between first sleeve 46 and second sleeve 50. As shown in FIG. 5, the lowermost end 47 of third sleeve 48 overlaps and abuts the uppermost end 45 of first sleeve 46 thereby forming an in-thrust bearing surface between first sleeve 46 and third sleeve 48. Similarly, the uppermost end 49 of third sleeve 48 overlaps and abuts the lowermost end 51 of second sleeve 50 thereby forming an in-thrust bearing surface between third sleeve 48 and second sleeve 50.

Third sleeve 48 is unattached (or "floating") with respect to journal 22 and roller cone 18. Thus, both of its end surfaces 47 and 49 can cooperate with the respective opposed end surfaces 45 and 51 of the other two sleeves to form in-thrust bearings.

For convenience, FIG. 5 shows the cone assembly with its axis oriented vertically. However, in use, the assembly would be oriented like the assembly shown in cross-section in FIG. 1, i.e. its axis would be inclined downwardly and radially inwardly. Since the opposed surfaces 45 and 47 are matingly beveled, as are opposed surfaces 49 and 51, then depending upon the precise angles of those bevels and on the exact angle of the axis of the cone assembly, it is possible that, as oriented for use, the radially innermost portions of surfaces 49 and 51 and the radially outermost portions of surfaces 45 and 47 will lie horizontally or nearly horizontally, and thus will not be able to take any substantial in-thrust loads. However, the portions of those surfaces lying diametrically opposite the horizontal portions, i.e. the radially outermost portions of surfaces 49 and 51 and the radially innermost portions of surfaces 45 and 47, will lie more nearly vertical, than the non-beveled surfaces 25 and 27 of the first embodiment, so that they are all the more effective in taking in-thrust.

It can be appreciated that, had the sleeves 46, 48 and 50 been formed with straight or unbeveled ends, like the sleeves of the first embodiment, the end surface area available for taking in-thrust would have been doubled. Even though the surfaces are in fact beveled in the embodiment of FIG. 5, there is still a general increase in the capability of the end surfaces of the sleeves to take in-thrust, thereby relieving the radial bearing surfaces from such thrust. Another way of approximately doubling the sleeve end surface area available for taking in-thrust, without using a floating sleeve such as 48, is to use four journal bearing sleeves, with alternate sleeves being interferece fitted or otherwise affixed to the cone and the journal respectively.

Figure 6:
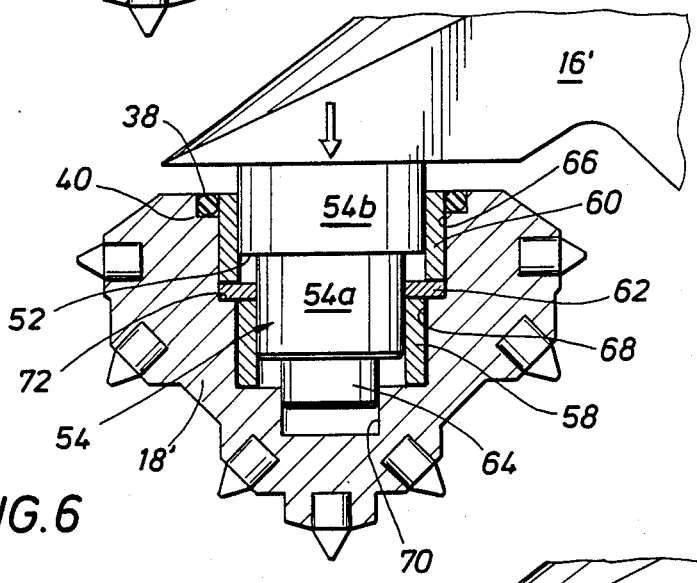
FIG. 6 is a longitudinal cross-sectional view of a third embodiment of cone assembly according to the present invention in a final stage of assembly.

While the three sleeves, 46, 48 and 50, have all been shown as having the same length, it is clear that sleeves of varying lengths may also be employed. It is, for example, possible to design a three-sleeve embodiment in which the third or middle sleeve bears only a relatively small portion of the main load on the drill bit but bears a relatively larger portion of the in-thrust load on the drill bit. Such a design is depicted in FIG. 6. The embodiment of FIG. 6 also illustrates how there can be means cooperative between the first and second sleeves to prevent relative movement of the second sleeve longitudinally past the first sleeve (and thus prevent the cone from moving off the journal) without actual abutment, or even direct opposition, between the adjacent ends of those sleeves.

In this embodiment, central sleeve 62 is configured to fit on the shoulder 52 formed between the large and small diameter portions of a stepped journal 54. More specifically, journal 54 has an axially innermost large diameter portion **54*b*, a small diameter portion 54*a* located axially outwardly thereof, and between which shoulder 52 is formed, as well as the usually nose piece 64 extending outwardly from the journal 54. The axial hollow space within cone 18' is similarly stepped so as to parallel the profile of the journal. Thus, that hollow space includes a large diameter portion 66, a smaller diameter portion 68, and an even smaller diameter portion 70, which receives the nose piece 64**.

To assemble the embodiment of FIG. 6, a first journal bearing sleeve 58 is inserted in portion 68 of the hollow space within the bit 18'. Sleeve 58 is sized to rotate with respect to surface 68, i.e. has a running fit therein. Next, the short central sleeve 62 is inserted so that it rests on the shoulder 72 formed at the innermost end of large diameter section 66, at the juncture thereof with section 68. The outer diameter of sleeve 62 is sized for a running fit within section 66, while its inner diameter is sized for a running fit on journal portion **54*a*. Therefore, sleeve 62 will be a "floating" sleeve. Next, sleeve 60 is interference fitted into large diameter section 66 of the hollow space in the cone, or otherwise affixed to the cone, as by welding. Finally, journal 54 is inserted into the hollow of the cone through the sleeves 58, 60, and 62. The diameter of journal portion 54*a* is sized to interfere with the inner diameter of sleeve 58, and the two are interference fitted together during such insertion, as shown in FIG. 6, so that the sleeve 58 becomes affixed to the journal. It should also be noted that the lengths of the various portions of journal 54 are chosen such that short central sleeve 62 will not bind between shoulders 52 and 72**, but rather, will be free to float or to rotate relative to the journal and/or the cone.

Even though there is no direct opposition between the ends of sleeves 58 and 60, i.e. even though these two sleeves are radially offset from each other, each of the three sleeves has a respective axially facing end surface opposed to a respective such surface of each adjacent sleeve. That is to say, the upper end of sleeve 58, as viewed in FIG. 6, is opposed to the lower end of sleeve 62, and the upper end of sleeve 62 is in turn opposed to the lower end of sleeve 60. Thus, considered all together, these end surfaces serve as retention surfaces cooperative between the sleeves 58 and 60, which are affixed to the journal and cone respectively, to prevent the cone from falling off the journal.

Figure 7:
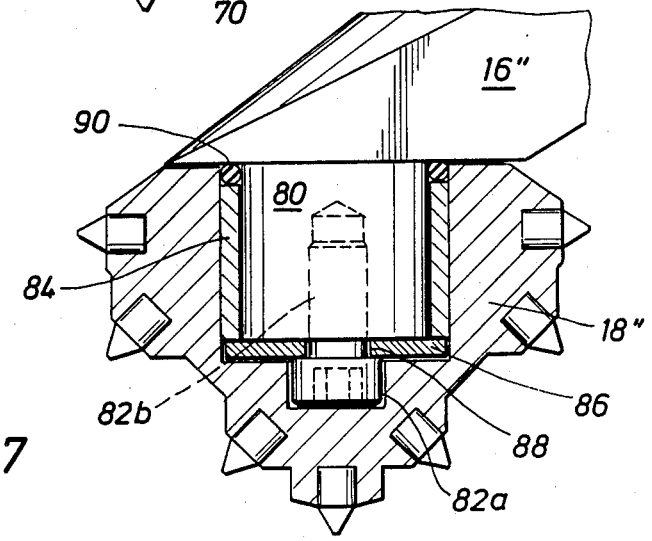
FIG. 7 is a longitudinal cross-sectional view of a fourth embodiment of a cone assembly according to the present invention, fully assembled.

Referring now finally to FIG. 7, there is shown, in fully assembled condition, still another alternate embodiment. The bit leg 16″ has an integral journal 80 of uniform outer diameter. The nose piece **82*a* is not formed integrally on the journal, as in the preceding embodiments, but rather is threadedly connected to the main portion 80 of the journal. More specifically, the nose piece 82 is formed by the head 82*a* of a screw, the shank 82*b* of which is threaded into journal 80**.

In all embodiments of the invention, a first retention member (journal bearing sleeve in the examples given thus far) is fixed to the leg of the bit—and more specifically to the journal formed thereon—while remaining rotatable relative to the cone. A second such retention member, disposed longitudinally inwardly of the first one, is fixed to the cone and rotatable relative to the leg. As previously explained, these retention members have means cooperative therebetween (such as directed abutting surfaces 25 and 27 in the first embodiment or intermediate sleeve members 46 and 62 in the second and third embodiments) to prevent relative movement of the second retention member longitudinally past the first retention member, and thus retain the cone on the journal. However, in all of the preceding embodiments, the method of assembly has involved installing the sleeves successivley in the cone and then finally inserting the journal bearing into the cone through the sleeves. The embodiment of FIG. 7 shows an assembly method in which the retention members are successively applied to the journal, whereafter the cone is then placed over the subassembly thus formed.

More specifically, a journal bearing sleeve 84 is first emplaced over journal 80, in coaxially surrounding relation thereto. Sleeve 84 has its inner diameter sized for a running fit on journal 80, so that it is rotatable with respect thereto. Since sleeve 84 is rotatable with respect to the leg, and will eventually be fixed to the cone, as described hereinafter, it is the "second" retention member as that term is used in this application, even though, in order of installation, it is emplaced first.

Next, another retention member in the form of an apertured disk 86 is placed in abutting relation to the axially outermost end of the journal 80. The aperture 88 in disk 86 is sized to receive the shank **82*b* of screw 82, but is smaller than the outer diameter of the screw head 82*a* which serves as the nose piece of the journal. Thus, after 10 emplacement of disk 86, screw 82 may be inserted through aperture 88 and threaded into journal 80, thereby simultaneously attaching the nose piece to the journal and fixing disk 88 to journal 80 by clamping it between the outer end of journal 80 and the underside of the head 82*a* of screw 82. The outer diameter of disk 86 is larger than that of journal 80, so that it extends beyond journal 80 out into the annular space formed between the journal and the cone hollow. Thus it opposes the outermost end of sleeve 84. Accordingly, sleeve 84 cannot move longitudinally past disk 86, and thus is retained on the journal 80**.

Finally, cone 18″ is emplaced over the subassembly consisting of members 80, 84, 86, and 82. The outer diameter of sleeve 84 is sized to interfere with the inner diameter of the aligned portion of the hollow in cone 18″, the latter being interference fitted thereover during the aforementioned emplacement. Disk 86, on the other hand, has an outer diameter small enough so that it is rotatable with respect to cone 18″.

In all of the preceding embodiments, the O-rings 38 which seal the cones against the bit legs are disposed radially outwardly of the adjacent sleeve or retention member. In the embodiment of FIG. 7, sleeve 84 is slightly shorter than journal 80, and O-ring 90 is place end-wise thereof. Indeed, O-ring 90 would be installed on the journal prior to sleeve 84. Thus, while the present invention allows the potential for radial bearing area along the full length of the journal, there may be some instances in which it is desired to utilize a part of that length for some other purpose, such as sealing by O-ring 90. However, embodiments such as that of FIG. 7 still remain advantageous in that, given the desire to utilize part of the length of the journal for sealing purposes, the potential bearing length does not have to be further sacrificed for purposes of retaining the cone on the bit, since the same pieces, i.e. sleeve 84 and disk 86, which serve to retain the cone on the bit also provide radial bearing along their own combined lengths. Furthermore, this bearing area is substantially uninterrupted. As in the preceding embodiments, the abutting end surfaces or retention surfaces of sleeve 84 and disk 86 can take in-thrust loads.

The foregoing represent only a few exemplary embodiments of preferred forms of the invention, and numerous modifications will suggest themselves to those of skill in the art. As previously mentioned, the number of retention members could be further increased, e.g. to include four or even more sleeves or other retention members stacked end-wise of one another, so as to further increase the available in-thrust area. Also, whereas in the exemplary embodiments, all of the cone retention members, which also serve as radial bearing members, have been annular, either sleeves, as in the first three embodiments, or a disk such as 86 of the embodiment of FIG. 7. However, it is also possible to use other types of retention members. For example, a plurality of arcuate members could be affixed, in circumferentially spaced relation, i.e. by welding them into the cone 18 in place of the sleeve 27, so that they would, in effect, form an interrupted or broken sleeve. Numerous other modifications not only of the specific form of retention member, but of other details of the exemplary embodiments, will suggest themselves to those of skill in the art. Accordingly, it is intended that the scope of the present invention be limited only by the claims which follow.

What is claimed is:

1. A roller cone type rock bit comprising:

a bit body including at least one depending leg, said leg having an outer free end and an inner end continuous with the remainder of said bit body;

a roller cone having an axial internal hollow disposed in generally coaxially surrounding relation to said leg adjacent said outer end and sized to define an annular space therebetween;

and a plurality of separately pre-formed retention members mounted in said annular space, a first of said retention members being mounted on said leg by an interference fit and rotatable relative to said cone, and a second of said retention members—disposed longitudinally inwardly of said first retention member along said leg—being fixedly mounted on said cone and rotatable relative to said leg, and said retention embers having means cooperative therebetween to prevent relative movement of said second retention member longitudinally past said first retention member.

2. A bit according to claim 1 wherein each of said retention members has a respective generally axially facing retention surface opposed to a respective such retention surface of each adjacent retention member, said means cooperative between said retention members comprising said retention surfaces.

3. A bit according to claim 2 wherein at least one pair of said opposed retention surfaces is adapted to function as means for bearing in-thrust loads on said cone.

4. A bit according to claim 3 wherein said one pair of opposed retention surfaces define substantially rectilinear profiles in longitudinal cross-section.

5. A bit according to claim 2 wherein said retention surfaces define substantially rectilinear profiles in longitudinal cross-section.

6. A bit according to claim 5 wherein each of said retention surfaces is in close proximity to the opposed retention surface of the adjacent retention member for sliding engagement of said surfaces.

7. A bit according to claim 2 wherein the portion of said leg surrounded by said hollow of said cone has a journal thereon.

8. A bit according to claim 7 wherein said second retention member is a journal bearing sleeve sized for a running fit on said journal.

9. A bit according to claim 8 wherein said first retention member is a journal bearing sleeve sized for a running fit in said hollow.

10. A bit according to claim 9 wherein said second retention member is so fixed to said cone by an interference fit.

11. A bit according to claim 9 wherein adjacent ends of said first and second sleeves form the respective retention surfaces thereof, said surfaces being disposed in close proximity with each other for sliding engagement.

12. A bit according to claim 11 wherein said first and second retention members extend along substantially the entire length of said journal.

13. A bit according to claim 7 wherein said retention members comprise journal bearing sleeve means providing generally uniterrupted radial bearing surface area along a major portion of the length of said journal.

14. A bit according to claim 13 wherein said journal sleeve means extend along substantially the entire length of said journal.

15. A roller cone type rock bit comprising:

a bit body including at least one depending leg, said leg having an outer free end and an inner end continuous with the remainder of said bit body, and said leg having a journal thereon adjacent said outer end;

a roller cone having an axial internal hollow disposed in generally coaxially surrounding relation to said journal and sized to define an annular space therebetween;

journal sleeve means disposed in said annular space and providing generally uninterrupted radial bearing surface area along a major portion of the length of said journal, said journal sleeve means being cooperative between said leg and said cone to retain said cone longitudinally on said leg while permitting relative rotation of said cone and said leg.

16. A bit according to claim 15 wherein said journal sleeve means extends along substantially the entire length of said journal.

17. A method of rotatably mounting a cone member for a roller cone type rock bit on a depending leg member of a bit body, wherein said leg member has cylindrical outer wall means with a first end which is free and a second end which is continuous with the remainder of said bit body, and said cone member has an axial internal hollow having cylindrical inner wall means with a first end adjacent the base of said cone and at which said hollow opens through said cone, and a second end adjacent the apex of said cone and which is closed, said method comprising the steps of:

placing first retention means adjacent the second end of the respective wall means of one of said members, and in relatively rotatable relation thereto, with said first retention means extending radially beyond the respective wall means to form a first axially facing shoulder;

then affixing second retention means to said one member adjacent the first end of its respective wall means, with said second retention means also extending radially beyond the respective wall means to form a second axially facing shoulder facing in a direction opposite to said first shoulder;

then telescoping said members so as to place said inner wall means in coaxially surrounding relation to said outer wall means and the other of said members in relatively rotatable relation to said second retention means;

and affixing said other of said members to said first retention means.

18. The method of claim 17 wherein said other member is fixed to said first retention means simultaneously as said members are telescoped by interference fitting.

19. The method of claim 18 wherein said second retention means is so affixed to said one member by interference fitting.

20. A bit according to claim 1 wherein said first and second retention are annular.

* * * * *